US005845171A

United States Patent [19]

Ko

[11] Patent Number: 5,845,171

[45] Date of Patent: Dec. 1, 1998

[54] TECHNIQUE FOR CONTROLLING DEVELOPING VOLTAGE OF IMAGE FORMING DEVICE

[75] Inventor: Chang-Kyung Ko, Suwon, Rep. of Korea

[73] Assignee: SamSung Electronics Co., Ltd., Suwon, Rep. of Korea

[21] Appl. No.: 864,272

[22] Filed: May 27, 1997

[30] Foreign Application Priority Data

May 27, 1996 [KR] Rep. of Korea ..... 96-18013

[51] Int. Cl.[6] ..... G03G 15/00

[52] U.S. Cl. ..... 399/44; 399/45; 399/55

[58] Field of Search ..... 399/44, 45, 55, 399/389

[56] References Cited

U.S. PATENT DOCUMENTS

| | | | |
|---|---|---|---|
| 3,926,519 | 12/1975 | Rebres | 399/45 |
| 4,373,801 | 2/1983 | Itoh | 399/45 |
| 5,034,772 | 7/1991 | Suzuki | 399/44 |
| 5,053,814 | 10/1991 | Takano et al. | 399/45 X |
| 5,099,287 | 3/1992 | Sato | 399/45 |
| 5,128,717 | 7/1992 | Uchikawa et al. | 399/44 |
| 5,128,718 | 7/1992 | Mizoguchi | 399/44 |
| 5,138,379 | 8/1992 | Kanazashi | 399/44 |
| 5,140,375 | 8/1992 | Shindo et al. | 399/45 |
| 5,146,274 | 9/1992 | Hattori et al. | 399/44 |
| 5,170,210 | 12/1992 | Saruwatari | 399/44 |
| 5,276,483 | 1/1994 | Hasegawa et al. | 399/44 |
| 5,307,134 | 4/1994 | Nakajima et al. | 399/45 |
| 5,465,135 | 11/1995 | Nakagama et al. | 399/44 |
| 5,486,903 | 1/1996 | Kanno et al. | 399/45 |
| 5,488,457 | 1/1996 | Nakagama et al. | 399/44 |
| 5,512,992 | 4/1996 | Kim et al. | 399/69 |
| 5,530,522 | 6/1996 | Tsunemi | 399/66 |
| 5,623,330 | 4/1997 | Ishibashi | 399/310 |

FOREIGN PATENT DOCUMENTS

| | | |
|---|---|---|
| 60-19177 | 1/1985 | Japan . |
| 1-179172 | 7/1989 | Japan . |
| 4-66970 | 3/1992 | Japan . |

*Primary Examiner*—William J. Royer
*Attorney, Agent, or Firm*—Robert E. Bushnell, Esq.

[57] ABSTRACT

A technique for controlling a developing voltage of an image forming device, which is capable of properly controlling the developing voltage according to thickness of the printing paper includes: setting a specific printing paper flag according to a key input generated by selection of specific printing paper by a user; checking whether or not the specific printing paper flag is set; and, upon determining that the specific printing paper flag has been set, controlling the developing voltage so as to be a developing voltage value corresponding to the proper amount of toner during forming an image on the specific printing paper.

8 Claims, 5 Drawing Sheets

TECHNIQUE FOR CONTROLLING DEVELOPING VOLTAGE OF IMAGE FORMING DEVICE

CLAIM OF PRIORITY

This application makes reference to, incorporates the same herein, and claims all benefits accruing under 35 U.S.C. §119 from an application for METHOD FOR CONTROLLING DEVELOPING VOLTAGE OF IMAGE FORMING DEVICE USING ELECTROPHOTOGRAPHIC DEVELOPING SYSTEM earlier filed in the Korean Industrial Property Office on the $27^{th}$ day of May 1996 and there duly assigned Serial No. 18013/1996, a copy of which application is annexed hereto.

BACKGROUND OF THE INVENTION

1. Field of the Invention

The present invention relates to an image forming device, and in particular, to a technique for controlling developing voltage of the image forming device.

2. Description of the Related Art

In general, processes to form an image by using an electrophotographic developing system in image forming devices, such as laser printers, copiers, plain paper facsimile machines, etc. are as follows: charging, exposing, developing, transferring, and fixing. In the developing step, an electrostatic latent image formed on the surface of a photosensitive drum by exposure is converted into a visible image through toner. A developing unit comprises a magnetic roller and a sleeve. The magnetic roller and the sleeve rotate at a high speed in the opposite direction to each other. As a result, the toner may be turned into a state of triboelectrification on the sleeve, thereby having a negative polarization. An output voltage in a power supply provided in the developing unit is called a developing voltage. The power supply is a variable voltage power supply. The toner is attached to an exposing domain of the electrostatic latent image on the photosensitive drum due to the difference between the developing voltage and the voltage on the photosensitive drum. The amount of the toner attached to the photosensitive drum is determined by the developing voltage and accordingly, the density of a printing image is determined.

As apparent from the foregoing, the image forming device using the electrophotographic developing system sets the developing voltage in conformity with usual printing paper conventionally used. As a result, when the image forming device performs a printing operation on thick printing paper or envelopes, that is, specific printing papers, not the usual printing papers, image quality is reduced. The density of the printing image can be reduced or a ghost image can be generated.

Meanwhile, under low humidity and low temperature, the resistance of a transferring roller is increased. As a result, the transferring feature is considerably reduced, thereby generating ghost images. In order to eliminate the ghost images, the earlier image forming device increased the transferring voltage. However, there is a limit in increasing the transferring voltage, so that it is difficult to prevent the transferring feature from being generated.

Besides, as stated previously, there is a problem with the earlier image forming device in that developing quality may be reduced when developing using the specific printing papers and that the transferring feature may also be reduced under low humidity and low temperature. The Saruwatari patent, U.S. Pat. No. 5,170,210, entitled Image Forming Apparatus Having Environmental Detecting Means For Achieving Optimum Image Density, discloses an image forming apparatus in which a voltage is controlled in accordance with environmental conditions.

The Sato patent U.S. Pat. No. 5,099,287, entitled Transferring Voltage Control Section, discloses an image forming apparatus in which the voltage is controlled in accordance with the type of paper.

The Nakajima patent, U.S. Pat. No. 5,307,134, entitled Electrophotographic Apparatus, discloses an image forming apparatus in which the fixing temperature is adjusted in accordance with whether the paper is fed via a sheet feeder or is manually fed.

The following additional patents each disclose features in common with the present invention but are not believed to be as pertinent as the patents discussed in detail above: U.S. Pat. No. 3,926,519 to Rebres, entitled Control Device For An Electrophotographic Printing Machine, U.S. Pat. No. 4,373,801 to Itoh, entitled Fixing Temperature Selecting Control In A Copying Machine, U.S. Pat. No. 5,486,903 to Kanno et al., entitled Image Forming Apparatus With Paper Thickness Detector, U.S. Pat. No. 5,512,992 to Kim et al., entitled Apparatus And Method For Controlling Fusing Temperature, U.S. Pat. No. 5,530,522 to Tsunemi, entitled Image Forming Apparatus With Controlled Transfer Voltage, U.S. Pat. No. 5,140,375 to Shindo et al., entitled Image Forming Apparatus, U.S. Pat. No. 5,623,330 to Ishibashi, entitled Image Forming Apparatus, U.S. Pat. No. 5,276,483 to Hasegawa et al., entitled Image Forming Apparatus Provided With An Attraction Charger Controlled By One Or More Ambient Conditions, U.S. Pat. No. 5,465,135 to Nakagama et al., entitled Charger Control In An Electrophotographic Copying Apparatus, U.S. Pat. No. 5,488,457 to Nakagama et al., entitled Image Forming Apparatus With Power Source Control, U.S. Pat. No. 5,128,717 to Uchikawa et al., entitled Image Forming Apparatus, U.S. Pat. No. 5,138,379 to Kanazashi, entitled Image Forming Apparatus Having Temperature And Humidity Detecting Means, U.S. Pat. No. 5,146,274 to Hattori et al., entitled Toner Density Measurement Apparatus Having Output Characteristics Variable With Humidity, U.S. Pat. No. 5,128,718 to Mizoguchi, entitled Image Forming Apparatus Responsive To Ambient Condition Detecting Means, and U.S. Pat. No. 5,034,772 to Suzuki, entitled Humidity Measurement Device And Image Forming Apparatus Having The Same.

SUMMARY OF THE INVENTION

It is therefore an object of the present invention to provide a technique for controlling the developing voltage of an image forming device, which is capable of properly controlling the developing voltage according to the thickness of the printing paper.

It is another object of the present invention to provide a technique for controlling the developing voltage of an image forming device, which is capable of properly controlling the amount of toner even under low humidity and low temperature.

To achieve the above objects, there is provided an apparatus aid a technique for controlling the developing voltage of an image forming device by setting a specific printing paper flag according to a key input generated by the selection of specific printing paper by a user; checking whether or not the specific printing paper flag is set; and, upon the specific printing paper flag being set, controlling the developing voltage so as to be a developing voltage value corresponding to the proper amount of toner during the forming of an image on the specific printing paper.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Now, a preferred embodiment of the present invention will be described in detail with reference to the accompanying drawings.

Figure 1:
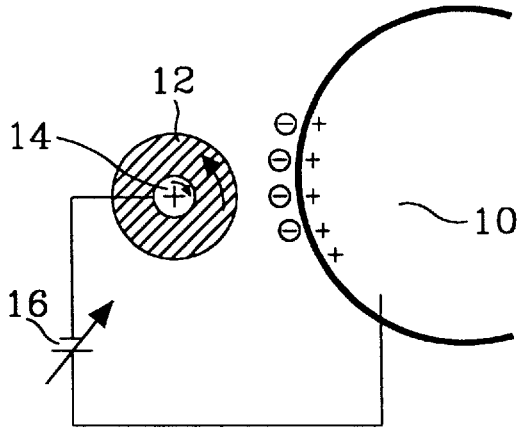
FIG. 1 is a view showing construction of the mechanism upon development in an electrophotographic developing system.
Figure 2:
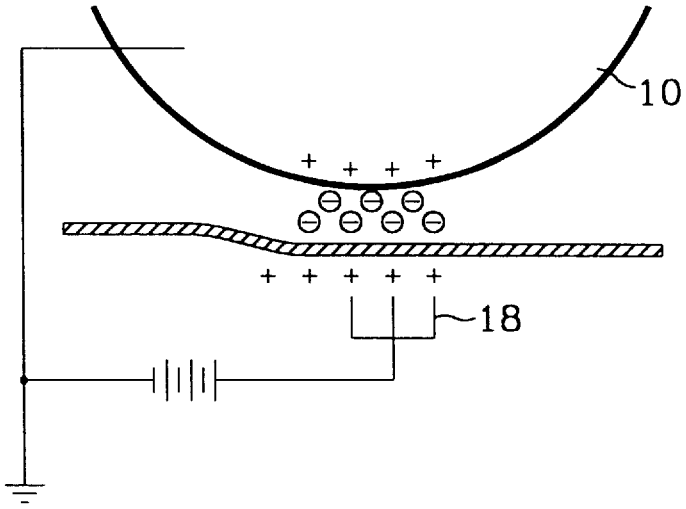
FIG. 2 is a view showing construction of the mechanism upon transfer in an electrophotographic developing system.

It will be apparent, however, to one skilled in the art that the present invention may be practiced without these specific details. A detailed description of known functions and constructions unnecessarily obscuring the subject matter of the present invention has been avoided in the present application. FIGS. 1 and 2 illustrate the construction of a representative of a hypothetical typical electrophotographic developing system.

An electrostatic latent image is formed on the surface of a photosensitive drum 10. A developing unit comprises a magnetic roller 14 and a sleeve 12. A variable voltage power supply 16 is provided in the developing unit.

As illustrated in FIG. 2, the toner particles are transferred during the transferring step to the paper in view of the transfer voltage supplied to the transfer voltage element 18.

Figure 3:
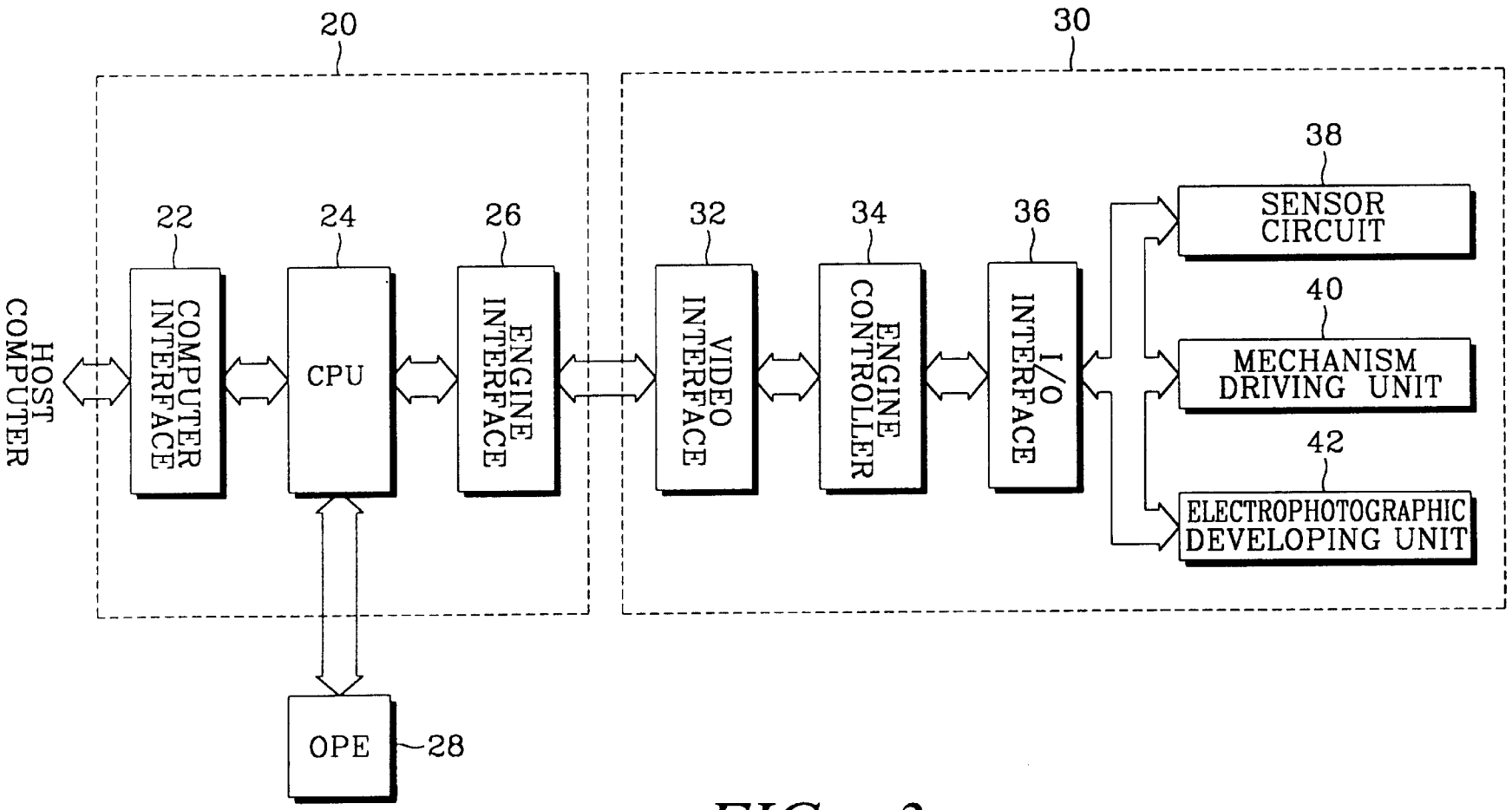
FIG. 3 is a block diagram showing a laser printer.

FIG. 3 is a block diagram showing a laser printer, which is comprised of a video controller 20, a print engine 30, and an operating panel (hereinafter, referred to as an OPE) 28. The video controller 20 is comprised of a computer interface 22, a central processing unit (hereinafter, referred to as a CPU) 24, and an engine interface 26. The computer interface 22, connected between a host computer (not shown) and the CPU 24, interfaces the signals between the host computer and the CPU 24. The CPU 24 includes a read only memory (hereinafter, referred to as a ROM) having controlling program and a random access memory (hereinafter, referred to as a RAM) for temporarily storing various data. The CPU 24 converts printing data received from the host computer via the computer interface 22 into image data capable of being processed by the print engine 30, and then transmits the converted image data to the print engine 30. The engine interface 26 interfaces input/output signals between the CPU 24 and the print engine 30. The OPE 28, controlled by the CPU 24, includes various keys for inputting various commands and a display for displaying information according to an operation of the laser printer. In particular, the OPE 28 includes a key for setting the printing operation for specific printing paper. Furthermore, the print engine 30, connected to the video controller 20, is comprised of a video interface 32, an engine controller 34, an input/output interface 36, a sensor circuit 38, a mechanism driving unit 40, and an electrophotographic developing unit 42. The video interface 32 interfaces the input/output signals between the video controller 20 and the engine controller 34. Under control of the video controller 20, the engine controller 34 controls the mechanism driving unit 40 and the electrophotographic developing unit 42, and prints an image according to the image data received from the video controller 20 onto the printing paper. The engine controller 34 senses an operational state of various units of the print engine 30 via the sensor circuit 38. The input/output interface 36, connected to the engine controller 34, the sensor circuit 38, the mechanism driving unit 40, and the electrophotographic developing unit 42, interfaces the input/output signals of the engine controller 34. The sensor circuit 38 drives various sensors for sensing the operational state of the various units of the print engine 30, paper feed state and paper conveyance state, developing material, etc., and provides sensing signals of the various sensors to the engine controller 34. Under control of the engine controller 34, the mechanism driving unit 40 drives various units for feeding the printing paper, conveying the printing paper, and performing the printing operation. Under control of the engine controller 34, the electrophotographic developing unit 42 prints the image according to the image data onto the printing paper using an electrophotographic developing technique.

Figure 4:
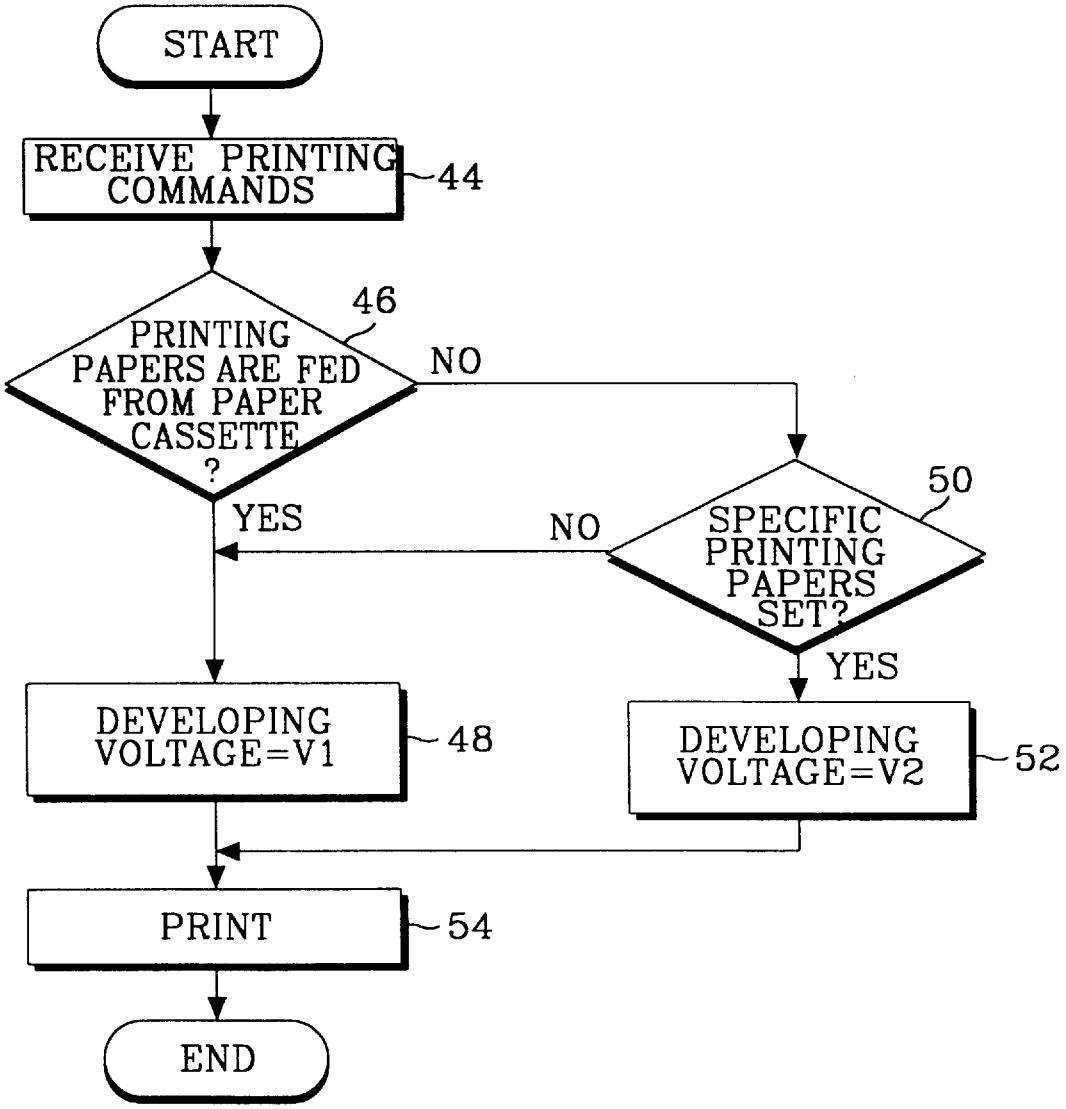
FIG. 4 is a flowchart showing a method of controlling the developing voltage of an image forming device according to an embodiment of the present invention.

FIG. 4 is a flowchart showing a method of controlling the developing voltage of the image forming device according to an embodiment of the present invention. When power is supplied to the laser printer, the CPU 24 initializes itself and then, goes into a standby state. In the standby state, when a user wants to perform the printing operation on specific printing paper, he can set the specific printing paper using the OPE 28. Upon the user setting the specific printing paper through inputting one key of the keys included in the OPE 28, data according to the key input is transmitted to the CPU 24. The CPU 24 receives the data according to the key input, and sets a specific printing paper flag. The specific printing paper flag can be reset when the power supply of the laser printer is reset When the user inputs the above key one more time, the CPU 24 receives the data according to the key input, and resets the specific printing paper flag.

When printing commands are transmitted from the host computer in the standby state, the CPU 24 proceeds to step 44. In step 44, the CPU 24 receives the printing commands, and converts the printing data into image data. Thereafter, the CPU 24 proceeds to step 46, checking whether or not the printing paper has been automatically fed from a paper cassette. When it has been determined in step 46 that the printing paper was automatically fed from the paper cassette, the CPU 24 proceeds to step 48, and if it has been determined that the printing paper was not fed from the paper cassette, the CPU 24 proceeds to step 50. A feed sensor is conventionally used to sense whether or not the printing paper has been automatically fed from the paper cassette. As is apparent from the foregoing, the step of checking whether or not the printing paper has been automatically fed from the paper cassette is conventional, so that a detailed explanation thereof has been omitted.

In step 50, the CPU 24 checks whether or not the specific printing paper has been set to manually feed the specific paper rather than automatically feeding paper from the paper cassette. Step 50 can be performed by checking whether or not the specific printing paper flag has been set and the paper manually fed. That is, when the specific printing paper flag has been set, the CPU 24 proceeds to step 52, and when the specific printing paper flag has not been set, the CPU 24 proceeds to step 48. In step 52, the CPU 24 sets the developing voltage to "V2". The voltage "V2" is the developing voltage proper to the previously set specific printing paper. The developing voltage can be set by changing the level of the variable power supply 16 as shown in FIG. 1. Upon completion of the setting of the developing voltage, the CPU 24 proceeds to step 54, and transmits the image data to the engine controller 34. Thereafter, the engine controller 34 prints the image according to the image data.

In step 48, the CPU 24 sets the developing voltage to "V1". Here, the voltage "V1" is the developing voltage proper to the usual printing paper. After that, the CPU 24 proceeds to step 54 to perform the corresponding operation.

As is apparent from the foregoing, when the user sets the printing operation using the specific printing paper, the present invention can control the developing voltage so as to be the proper developing voltage value for the specific printing paper, thereby improving the developing feature as well as the image quality.

Figure 5:
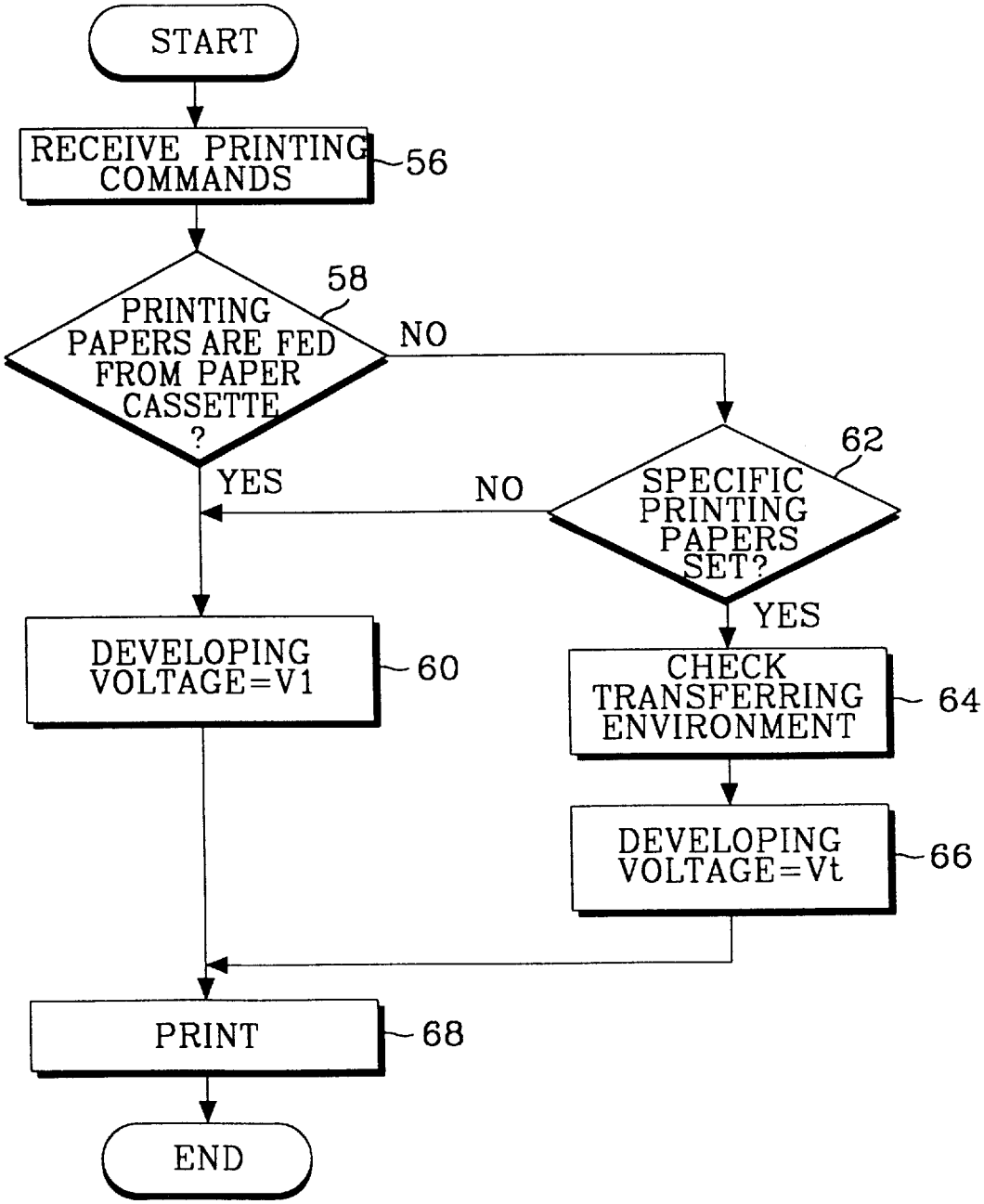
FIG. 5 is a flowchart showing a method of controlling the developing voltage of an image forming device according to another embodiment of the present invention.

FIG. 5 is a flowchart showing a method of controlling the developing voltage of the image forming device according to another embodiment of the present invention.

Upon the power being supplied to the laser printer, the CPU 24 initializes itself and then, goes into its standby state. In the standby state, when the user wants to perform the printing operation using the specific printing paper, he can set the specific printing paper using the OPE 28. Upon the user setting the specific printing paper by inputting one key of the keys included in the OPE 28, the data according to the key input is transmitted to the CPU 24. The CPU 24 receives the data according to the key input, and sets the specific printing paper flag. The specific printing paper flag can be reset when the power supply is reset. When the user inputs the above key one more time, the CPU 24 receives the data according to the key input, and resets the specific printing paper flag.

When the printing commands are transmitted from the host computer in the standby state, the CPU 24 proceeds to step 56, thereby receiving the printing commands and converting the printing data into image data. After that, the CPU 24 proceeds to step 58, and checks whether or not the printing paper has been automatically fed from the paper cassette. When it has been determined that the printing paper has been automatically fed from the paper cassette, the CPU 24 proceeds to step 60, and when it has been determined that the printing paper has not been automatically fed from the paper cassette, the CPU 24 proceeds to step 62. In step 62, the CPU 24 checks whether or not the specific printing paper flag has been set in order to check whether or not the specific printing paper has been manually set. When it has been determined that the specific printing paper flag has been set, the CPU 24 proceeds to step 64, and when it has been determined that the specific printing paper flag has not been set, the CPU 24 proceeds to step 60. In step 64, the CPU 24 checks a transferring environment. Step 64 can be performed by checking a resistance value of a transferring roller according to the temperature and humidity. The resistance value is increased under low temperature and low humidity, while the resistance value is decreased under high temperature and high humidity.

After step 64, the CPU 24 proceeds to step 66, thereby setting the developing voltage to "Vt". The "Vt" is determined by the relationship between the transferring voltage and the developing voltage according to the resistance value of the transferring roller as determined in step 64. The developing voltage corresponding to the transferring voltage is stored in advance in a memory. As a result, after checking the transferring environment in step 64, the CPU 24 reads the developing voltage corresponding to the transferring voltage and then sets the read developing voltage to the developing voltage.

Figure 6:
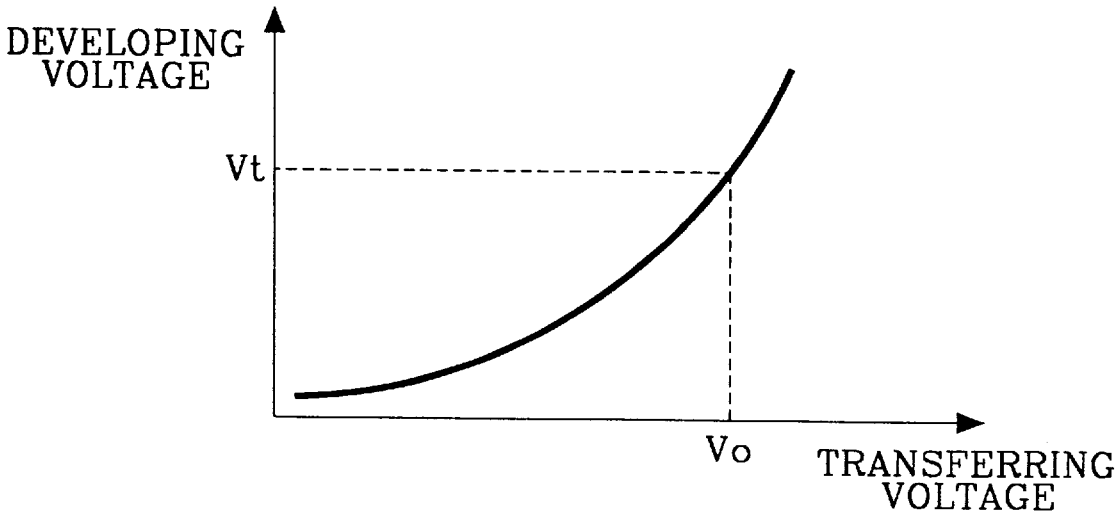
FIG. 6 is a view showing a relationship between the developing voltage and transferring voltage.

FIG. 6 is a view showing the relationship between the developing voltage and the transferring voltage. As shown FIG. 6, the transferring voltage is proportional to the developing voltage. After setting the developing voltage in step 66, the CPU 24 proceeds to step 68, thereby transmitting the printing commands to the engine controller 34. At this time, the engine controller 34 prints the image according to the image data in correspondence with the printing commands. In step 60, the CPU 24 sets the developing voltage to voltage "V1". The voltage "V1" is the developing voltage proper to the usual printing paper. Thereafter, the CPU 24 proceeds to step 68 to perform the corresponding operation.

Since the developing voltage is controlled in correspondence with the transferring voltage according to the transferring environment, the present invention can improve the transferring feature by lowering the developing voltage and then reducing the amount of the toner upon the lowering of the transferring voltage under low temperature and low humidity.

As apparent from the foregoing, the present invention has an advantage in that, when the user selectively sets the specific printing paper, the user can vary the developing voltage in correspondence with the set specific printing paper and then, develops the image, thereby improving the developing feature as well as the image quality. The present invention can control the amount of the toner under the low temperature and low humidity, thereby preventing the image quality from being deteriorated in spite of depreciation of the transferring feature thereunder.

While there have been illustrated and described what are considered to be preferred embodiments of the present invention, it will be understood by those skilled in the art that various changes and modifications may be made, and equivalents made be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A method of controlling a developing voltage of an image forming device, comprising the steps of:

setting a specific printing paper flag according to a key input generated by selection of specific printing paper by a user;

checking whether or not said specific printing paper flag has been set and said specific printing paper fed; and upon determining that said specific printing paper flag has been set and said specific printing paper fed, controlling the developing voltage so as to be a developing voltage value corresponding to the proper amount of toner during forming an image on said specific printing paper.

2. The method according to claim 1, further comprising the step of:

upon determining that said specific printing paper flag has not been set and said specific printing paper not fed, controlling the developing voltage so as to be a developing voltage value corresponding to the proper amount of the toner during forming an image on usual printing paper.

3. A method of controlling a developing voltage of an image forming device, comprising the steps of:

setting a specific printing paper flag according to a key input generated by selection of specific printing paper by a user;

checking whether printing paper has been fed automatically;

checking whether or not said specific printing paper flag has been set and the printing paper manually fed; and upon determining that said specific printing paper flag has been set and the printing paper was manually fed, controlling the developing voltage so as to be a developing voltage value corresponding to the proper amount of toner during forming an image on said specific printing paper.

4. The method according to claim 3, further comprising the step of:

upon determining that said specific printing paper flag has not been set and the printing paper was automatically fed, controlling the developing voltage so as to be a developing voltage value corresponding to the proper amount of the toner during forming an image on usual printing paper.

5. A method of controlling a developing voltage of an image forming device, comprising the steps of:

setting a specific printing paper flag according to a key input generated by selection of specific printing paper by a user;

checking whether or not said specific printing paper flag has been set;

upon determining that said specific printing paper flag has been set, checking transferring environment and transferring voltage; and controlling the developing voltage so as to be a developing voltage value corresponding to said checked transferring voltage.

6. The method according to claim 5, further comprising the step of:

upon determining that said specific printing paper flag has not been set, controlling the developing voltage so as to be a developing voltage value corresponding to the proper amount of the toner during forming an image on usual printing paper.

7. A method of controlling a developing voltage of an image forming device, comprising the steps of:

setting a specific printing paper flag according to a key input generated by selection of specific printing paper by a user;

checking whether said specific printing paper are fed automatically;

checking whether or not said specific printing paper flag has been set and the printing paper manually fed;

upon determining that said specific printing paper flag has been set and the printing paper was manually fed, checking transferring environment and transferring voltage; and controlling the developing voltage so as to be a developing voltage value corresponding to said checked transferring voltage.

8. The method according to claim 7, further comprising the step of:

upon determining that said specific printing paper flag has not been set and the printing paper was automatically fed, controlling the developing voltage so as to be a developing voltage value corresponding to the proper amount of the toner during forming an image on usual printing paper.

* * * * *